United States Patent [19]

Pierce

[11] 4,323,117

[45] Apr. 6, 1982

[54] METHOD AND MEANS FOR EMERGENCY SHEARING AND SEALING OF WELL CASING

[76] Inventor: Laurance Pierce, 4652 Tonywatha Trail, Monona, Wis. 53716

[21] Appl. No.: 143,023

[22] Filed: Apr. 23, 1980

[51] Int. Cl.[3] ..... E21B 29/08; E21B 33/06

[52] U.S. Cl. ..... 166/55; 102/307; 166/361; 166/63

[58] Field of Search ..... 166/361, 364, 299, 55, 166/55.2, 63, 90; 102/307, 310; 89/1 B, 1 C; 251/1 R

[56] References Cited

U.S. PATENT DOCUMENTS

| | | | |
|---|---|---|---|
| 1,851,894 | 3/1932 | Clough | 166/55 |
| 2,543,057 | 2/1951 | Porter | 102/307 |
| 2,737,115 | 3/1956 | Bissell | 175/4.52 |
| 2,761,384 | 9/1956 | Sweetman | 166/55 |
| 3,561,526 | 2/1971 | Williams, Jr. | 166/55 |
| 3,828,408 | 8/1974 | Ortiz | 166/55 |
| 4,140,041 | 2/1979 | Frelau | 166/55 |

*Primary Examiner*—James A. Leppink
*Attorney, Agent, or Firm*—Keith Schoff

[57] ABSTRACT

Natural gas deposits vented by oil or gas wells may pressurize a well beyond the capacity of installed apparatus to contain damage in the event of equipment failure, blow-out, or fire with the result that a well may flow out of control. The means and method of this invention provide for emergency action to shear a well casing together with internal piping or tubing and to seal a well if blow-out preventers otherwise provided do not prove effective. The apparatus of this invention may be self-powering.

10 Claims, 4 Drawing Figures

METHOD AND MEANS FOR EMERGENCY SHEARING AND SEALING OF WELL CASING

BACKGROUND OF THE INVENTION

Blow-out preventers are provided in well casings of oil and gas wells as standard practice. Commonly such preventers comprise an integral part of the well casing, being installed as a linear section of the casing with oppositely disposed hydraulically powered rams actuatable either to close an annulus between the casing well and drill pipe or the like centrally disposed within the casing bore or to shear such piping and completely seal the casing. If such equipment fails to function adequately or if casing rupture occurs below the location of of a blow-out preventer, as by a floating drilling platform being shifted from anchored position by heavy seas and moving the casing laterally or for whatever reason, it may be necessary to cut and cap a well casing anywhere along its length.

PRIOR ART

Blow-out preventers for oil and gas well casings and shear rams for severing drill pipe within a casing are described in U.S. Pat. Nos. 3,272,222 and 3,561,526 and are exemplified by products manufactured by Cameron Iron Works, Houston, Texas. Such means are installed as an integral part of a well casing and are permanently fixed in place. U.S. Pat. No. 1,949,672 describes a housing to be clamped in place about well casing to pinch it without severing the casing, providing a side tap in the pinched-off casing for diverting flow from the well, however, the presence of drill pipe or tubing within a casing would render such apparatus non-utilitarian. In U.S. Pat. No. 3,603,387 a housing for clamping about well casing is disclosed and in which a rotary cutting blade is actuated and advanced to cut a casing transversely and then be secured hydraulically against the severed end of the casing to cap it. The device is not disclosed for use with casing in which drill pipe or tubing is disposed and which would be supported by the cutting blade when severed so as to interfere with further cutting operation of the blade The apparatus described in U.S. Pat. Nos. 1,875,673 and 3,590,920 entail use of unitary housings for shear rams which are installed in conjunction with installation of well head apparatus, the former providing a soft metal section in the upper portion of well casing for enabling a ram to operably sever a casing and the latter providing for the installation of shear rams at multiple locations of pipe section joints in a pipe string running from a sea bed well head to a production platform at the surface with one such device placed at a non-connected joint to ensure that the string will be severed by actuation of the devices.

SUMMARY OF THE DESCRIPTION

Embodiments of this invention are configured as split housings for being tightly clamped or otherwise affixed to girdle well casings anywhere along the casing lengths and to be actuated to sever both a casing and pipe or tubing which may be disposed within a well, and cap the well casing to stop flow from the well. Severing of the casing is preferably accomplished or aided by use of shaped charges disposed in the housing to ring the casing and which upon ignition cut the casing without deforming it and enable hydraulically actuated shear rams to complete the procedure by shearing any remaining material in the casing and internally disposed pipe or tubing and move into tight facing contact to seal the casing. The design and actuation of the shear rams is in material respects similar to that described in U.S. Pat. No. 3,561,526 with the salient difference, however, that such means are disposed to operably traverse through a severed well casing rather than being disposed to traverse the bore of an intact casing only. Shaped charge as are used to sever a well casing in the manner disclosed are devices defined in Merriam Webster's Third International Dictionary as "an explosive charge the enerby of which is focused in one direction; especially a charge in a projectile so packed that an empty cone is left in the nose in which the force of the explosion on impact is directed largely to the front with armor-penetrating effect." Such charges as conventionally employed to perforate oil well casing may be employed in accordance with this invention, although two semi-circular charges of "V" configured cross-section placed together to encircle a casing are a preferred configuration. If desired, shear rams used in the described invention may be configured to seal about piping internally of a casing rather than to sever such piping, all in accordance with means embodied in state of the art blow-out preventers.

In one embodiment of this invention, gas pressure in a well may be utilized to drive a hydraulic pump to power the shear rams and render the device independent of an external power supply source.

DESCRIPTION OF THE INVENTION

Figures 1, 4:
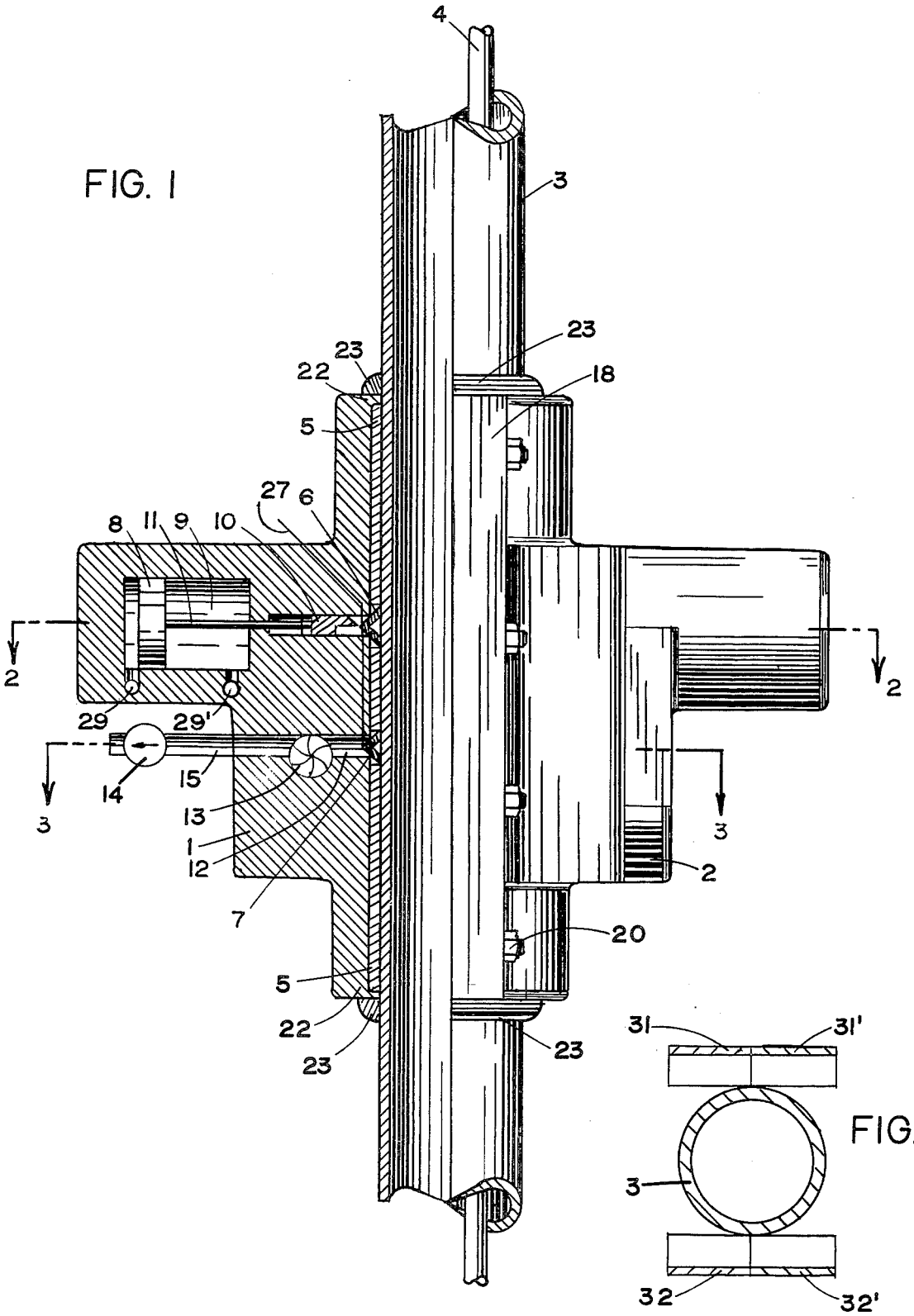
FIG. 1 is an elevation in partial section of a portion of an oil well casing with a shearing device of this invention applied to an unjointed section of the casing.
FIG. 4 is a plan view in section of a modification of the means of FIG. 2.
Figure 2:
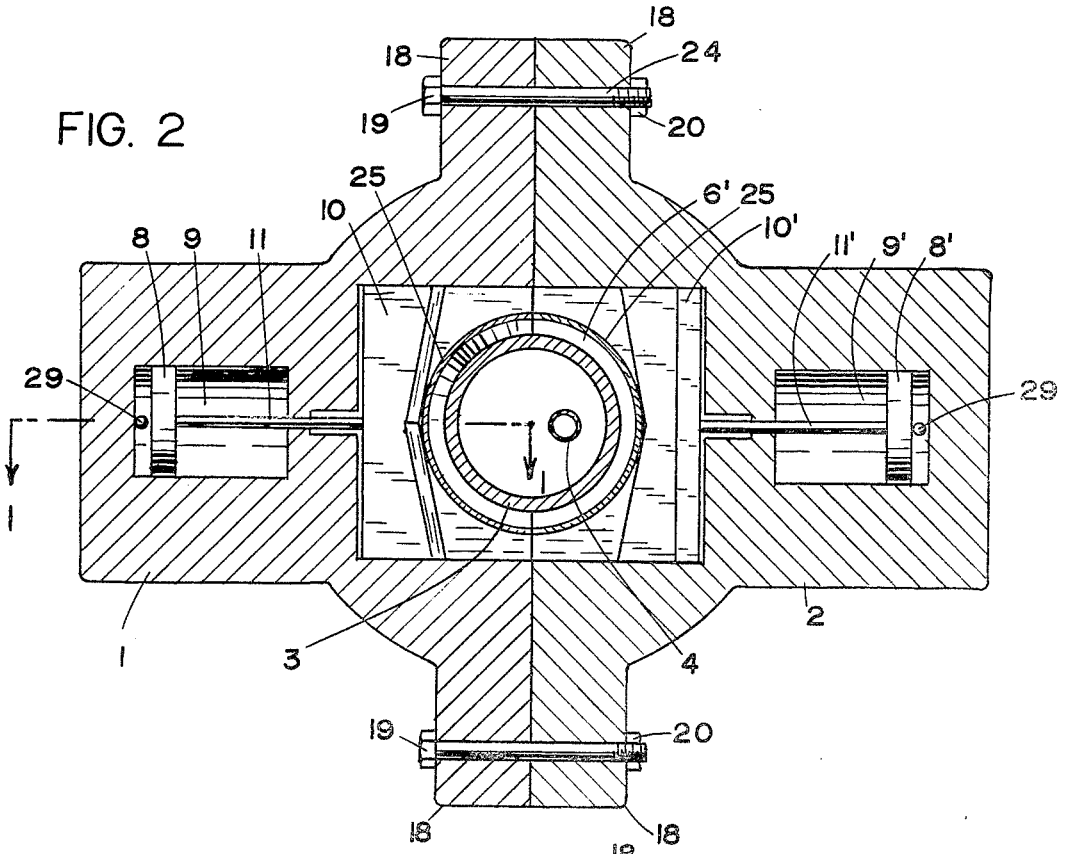
FIG. 2 is a plan view of the device of FIG. 1 taken along cutting plane 2—2.
Figure 3:
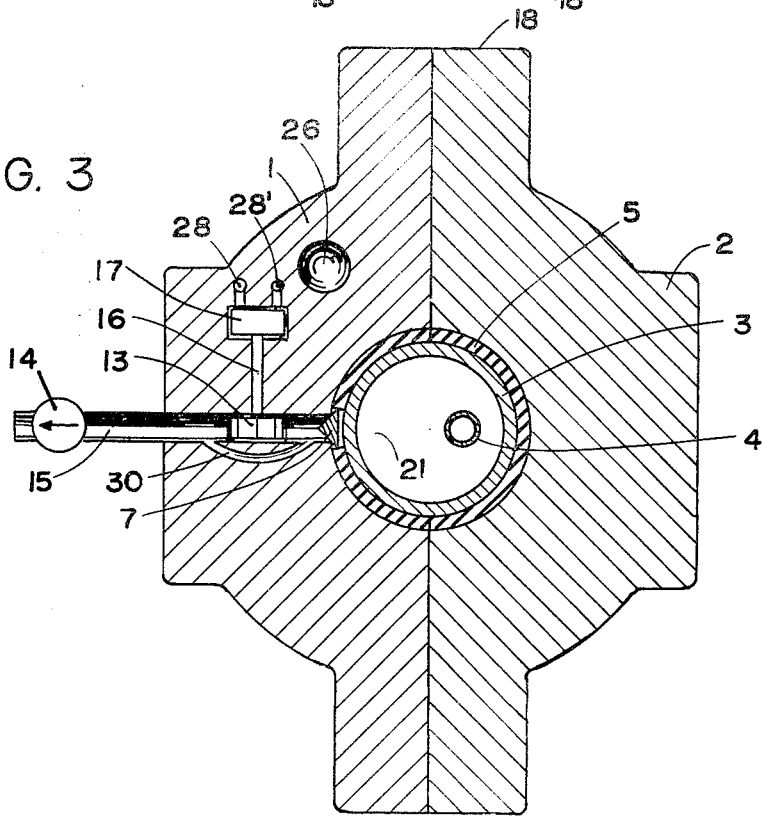
FIG. 3 is a plan view of the device of FIG. 1 taken along cutting plane 3—3.

In FIG. 1 oil well casing 3 is shown with drill pipe 4 extending longitudinally within the casing bore 21. Split housing portions 1 and 2 are applied to the exterior of an unprepared length of casing 3 and are firmly clamped about casing 3 and into facing contact by means of nuts 20 threaded on bolts 19. In addition, as an optional fastening means which is not essential for use of the inventive embodiment, weld fillets 23 are shown at the top and bottom extremities, lips 22 of the housing portions, joining the housing to casing 3. As shown in FIG. 2, semi-circular shaped charges 6, 6' are disposed, one in each housing portion 1 and 2, girdling casing 3 and connected by detonation wire 27. In addition wire 27 serves to detonate single shaped charge 7 as shown in FIG. 3. Sealing gasket 5 of any operable material such as asbestos, soft metal, or synthetic resin sheeting material is shown disposed interfacing housing portions 1 and 2, with casing 3. Electrical connector means for electrical conductor 27 may be provided between housing portions 1 and 2 by means of a bayonet fitting or other operable means, not shown. Gasketing may also be provided at the interfaces of flanges 18, 18' of housing portion 1 and 2 to effect an operable seal against infitration of foreign substances including water vapor from external sources as well as sealing against outflow of the fluid within well casing 3, but such means are not shown.

Chisel configured ram blades 10, 10' are set to move in substantially coincident horizontal planes into overlapping sealing contact one with the other in the manner described for such means in U.S. Pat. No. 3,561,526; alternatively, such blades may be configured to seal around pipe 4 in the manner provided in Model U blow-out preventer manufactured by Cameron Iron Works, Houston, Tex. Shield 25 disposed between shaped charges 6, 6' and the leading edge of blades 10, 10' is configured to conform to the desired shape of each such surface and provide support and protection, respectively, for the two members. Shield 25 preferably comprises a soft, easily cut material which will undergo surface vaporization without melting of the mass of the body of the material, such materials being well known for ablation shields on re-entry vehicles for space missions. A fiber matrix may be provided in conjunction with a shield of such material to prevent fracture from opening in such material when subjected to flame propation from an oppositely facing shaped charges disposed across the diameter of casing 3. Shaped charges as functional herein include all explosives configured to exhibit the munroe effect, that is, with the face of the explosive charge recessed as a concavity which produces convergence of shock waves upon detonation of the charge, with a conically recessed face producing pencil-like penetration and a linearly grooved face producing a planar configured flame propagation, the latter configuration either linear or curvilinear being preferred herein, but either hemispherically shaped concavities or conically shaped ones being applicable. Shaped charges are universally used for perforating oil and gas well casings at the desired depth in the producing strata and such charges may be used in embodiments of this invention.

In the manner of well known blow-out preveters, shear ram blades 10, 10' are fixed to end extremities of connecting rods 11, 11', respectively, the other ends of the rods being fixed to pistons 8, 8', respectively. Hydraulic pump 17 communicates to cylinder 9 through passages 28, 28' and ports 29, 29'. Branch passages to cylinder 9' are provided through means of conventional self-sealing quick disconnect hydraulic fittings disposed at the interface of housing portions 1 and 2, such means not being shown. Cylinder 9 as shown is fitted for being double acting, however, a single acting connection is utilitarian. Hydraulic fliud accumulator 26 is provided and gives convenient access for charging and purging the hydraulic system.

Casing 3 may be vented below shear ram blades 10, 10' by being perforated by shaped charge 7, wired by conduction 23' in parallel with the charges for severing casing 3, thereby communicating bore 21 with passage 15 and bypass passage 30 to exit from the apparatus through valve 14. Impeller 13 is shown operably disposed to be operably driven by flow of fluid from bore 21 through passage 15 and to drive hydraulic pump 17 by means of connecting shaft 16. Thus, shear ram blades 10, 10' can be actuated and closed if necessary in the absence of externally supplied power simply by actuation of means detonating the shaped charges to shear the well casing and piping and to perforate the well for flow to reach turbine impeller 13. However, it is contemplated that in regular operation pump 17 will be driven by electric motor drive means, not shown, in conventional manner.

In FIG. 4 a modification of the invention is shown with rectilinearly configured shaped charges 31, 31', 32, 32' set oppositely facing one another to propagate planar jets of flame in directions transverse to the direction of movement of shear ram blades such as shown in FIG. 2. The bodies of the charges shown in FIG. 4 are of elongated "V" configuration, shown sectioned through the middle or vertex of the "V" angle. The selection of explosive energy desired and of charge placement and configuration will be dictated by the character of the material to be severed; if massive pipe such as of about at least one and one-half inch wall thickness pipe known as drill collar extends through the bore 21 of casing 3 where it is desired to sever the casing, then charges of greater energy and cutting ability than would otherwise be selected would be used and the arrangement shown in FIG. 4 would be preferred for such purpose, i.e. wherein the path of flame propagation is into a thick mass of housing portions 1 and 2 and not toward the shear ram mechanism, there being no adverse effect or undue structural weakening of the device if the body of housing portion 1 and 2 disposed behind shaped charges 31, 31', 32, 32' is penetrated some distance. If desired, shaped charges may be placed only to one side of the well casing 3 in the embodiment of FIG. 4 without altering the functional effect provided. Particularly in instances where piping internal of bore 21 above the elevation where it is desired to sever the casing is unsupported or inadequately supported it may be desirable to provide a small spacing between next adjacent shaped charges such as 31, 31', 32, 32' to provide thin unsevered supporting pillars in the internal piping to enable shear ram blades such as 10, 10' to move freely into the casing and partially severed pipe before encountering resistance and to invade the remaining space and close together by shearing only the unsevered pillars in the casing and piping. Partial severing of pipe such as drill collar by explosive means herein is required because state of the art shear rams incorporated in blow-out preventers, alone are incapable of shearing drill collar and it is unlikely that increasing the size and power of such means will be efficacious to shear drill collar.

In variations of the embodiments of this invention, conical or other wise configured shaped charges may be used in place of those illustrated and maybe place to fire substantially tangentially of the well casing or radially thereof or at some other angle. If desired, shear rams may be replaced by blades configured to seal about internal piping in the manner of conventional blow-out preventers rather than shearing such piping.

In embodiments of the invention described, it is intended that utilization of impeller 13 to drive hydraulic pump 17 is supplemental and secondary to conventional pump drive means such as electric motor means, but such conventional means are not shown in the drawings. In the event where external power has not been connected or where such connection is disabled, ram blades 10, 10' can be functionally operated and closed by impeller 13 alone in driving pump 17, when well pressure is sufficient for the purpose, it being understood that minimal hydraulic pressure only will be required to close shear ram blades 10, 10' operably into sealing contact where all cutting of the casing and internal piping is accomplished through flame cutting by shaped charges.

I claim:

1. Apparatus for being applied externally to a well casing to girdle it for emergency shearing of the casing to terminate uncontrolled flow from a well comprising a longitudinally split body structure configured for being operably fastened to girdle a well casing, ram means housed in said body actuatable to traverse said casing transversely to the axis of said casing for sealing said casing against uncontrolled flow therethrough, shaped charge explosive means provided in said body structure disposed for being actuated to ring said casing with perforations at an elevational level substantially the same as that of said ram means.

2. The apparatus of claim 1 wherein said shaped charges comprise unequal length facial axes perpendicular to the axis of explosive force propagation.

3. The apparatus of claim 2 wherein said shaped charges are configured with an arced face in a plane perpendicular to the axial length of said casing.

4. The apparatus of claim 1 wherein said shaped charge explosive means comprise multiple numbers of discrete conically configured means.

5. The apparatus of claim 1 comprising turbine impeller means for driving actuation of said ram means and further comprising means for perforating well casing to communicate fluid therein with said turbine impeller for energizing said impeller operably.

6. The apparatus of claim 1 wherein said ram means comprise blades configured to seal around fluid conducting means disposed within said casing.

7. The apparatus of claim 1 wherein said ram means is configured to sever fluid conducting means disposed within said casing.

8. The apparatus of claim 1 wherein said shaped charge explosive means are disposed extending substantially tangential to said casing.

9. The apparatus of claim 1 wherein said shaped charge explosive means are disposed substantially curvilinearly extending in a circumferential plane at least partially around said casing.

10. The apparatus of claim 1 wherein said ram means are actuated at least in part by motive force supplied by fluid force within said well casing.

* * * * *